United States Patent [19]

Hatje et al.

[11] 4,232,734

[45] Nov. 11, 1980

[54] TRICKLER HEAT-EXCHANGE APPARATUS

[75] Inventors: Erich Hatje, Watenbüttel; Norbert Reinert, Brunswick, both of Fed. Rep. of Germany

[73] Assignee: Buehler-Miag GmbH, Brunswick, Fed. Rep. of Germany

[21] Appl. No.: 803,352

[22] Filed: Jun. 3, 1977

[51] Int. Cl.[3] ..... F28F 25/04

[52] U.S. Cl. ..... 165/118; 62/304; 239/145; 261/112

[58] Field of Search ..... 165/115, 118; 239/145; 261/112, 103; 62/304

[56] References Cited

U.S. PATENT DOCUMENTS

| | | | |
|---|---|---|---|
| 531,433 | 12/1894 | Brooks | 239/145 |
| 1,138,505 | 5/1915 | Pittman | 62/304 |
| 1,639,857 | 8/1927 | Planski | 165/115 |
| 1,942,696 | 1/1934 | Helwege | 165/118 |
| 1,984,581 | 12/1934 | Hasselberg | 165/118 |
| 2,099,157 | 11/1937 | Wiggenhorn | 62/304 |
| 3,799,442 | 3/1974 | Delmer | 239/145 |
| 3,913,667 | 10/1975 | Meylan et al. | 165/115 |

*Primary Examiner*—Sheldon Richter
*Attorney, Agent, or Firm*—Michael J. Striker

[57] ABSTRACT

The upper end portion of an upright tubular wall whose inner side is contacted by material requiring to be cooled, is surrounded by an annular receptacle for cooling water. An annular baffle extends from the receptacle towards but not into contact with the exterior of the wall; its free edge defines with the wall an annular gap. This gap is bridged by tufts of fibers which are arranged along the gap in one or more rows, so that water running from the receptacle over the baffle travels along the fibers whose free ends are in contact with the wall, and is applied to the wall of a film of uniform thickness.

12 Claims, 4 Drawing Figures

TRICKLER HEAT-EXCHANGE APPARATUS

BACKGROUND OF THE INVENTION

This invention relates to heat-exchange apparatus, and more particularly to apparatus wherein cooling water is supplied to a surface of a cooling jacket or wall. It is particularly well suited for cooling a jacket of a cooler used in the manufacture of cement, but is not limited thereto.

Coolers of the type used in the manufacture of cement have an upright tubular (cylindrical) jacket or wall. The hot cement gruel, which may have a temperature up to about 120° C., is advanced along and in contact with the inner side of the jacket. To cool this gruel, hereafter called the material for convenience, cooling water is made to flow over the outer side of the jacket. Proper cooling is extremely important and it is essential that a constant film (of small thickness) of such cooling water flows over this outer side and cools all portions thereof.

If the thickness of this water film becomes too great, the danger develops that the water may lift off the jacket surface and flow in free-falling ribbons or streams. This results not only in excessive use of water but in poor cooling. On the other hand, if the film thickness is too small then the water turns to steam as it runs over the jacket; the negative effects of steam in a cement-manufacturing plant are known and need not be described here in detail. Furthermore, in this situation there is again the inevitable reduction of cooling capacity when areas of the jacket surface become dry due to the steam formation.

In coolers of the type which is being described here it is, therefore, extremely important to assure that the cooling water flows over the cooling jacket in form of a continuous film of substantially uniform thickness, which film must be present over the entire circumference of the jacket; splashing, free-falling or flashing of the water into steam must be avoided.

In the prior art it has been proposed to surround the jacket with an annular water trough from which the water runs onto an annular, downwardly inclined guide baffle. A free edge of the baffle defines with the jacket a narrow annular gap through which the water runs. However, the cooperating parts (i.e. the baffle and the jacket) are sheet-metal elements which are not (and are not intended to be) manufactured to particularly close tolerances; to do so would make them uneconomically expensive. Due to this tolerance problem neither the baffle nor the jacket are completely round; the width of the gap therefore varies over the gap circumference and, as a consequence, the thickness of the water film is not uniform everywhere. The above-discussed disadvantages are therefore not effectively avoided. A proposal has been made to install thin metal lips in the gap in order to avoid "sheeting" of the water, i.e. free fall out of contact with the jacket; however, this is not particularly effective and, moreover, whenever a foreign body (e.g. dirt, mineral deposit which breaks off the trough) enters the gap, it immediately serves to direct the water away from the jacket and to cause sheeting.

Another proposal involves the use of a pressurized water container having an outlet gap which is closed by a lip-shaped rubber seal. Under the pressure of water in the container the seal is deflected and permits the outflow of a certain quantity of water onto the jacket per unit time. This arrangement, also, fails to avoid the formation of steam and does not ensure uniform distribution of the cooling water about the jacket in form of a water film.

SUMMARY OF THE INVENTION

Accordingly, it is an object of the invention to avoid the disadvantages of the prior art.

More particularly, it is an object of the invention to provide an improved apparatus wherein cooling water is applied onto a cooling jacket in form of a film of predetermined and substantially uniform thickness.

Another object is to provide an apparatus of the type under discussion, which reliably avoids sheeting of the cooling water and the formation of steam.

In pursuance of these objects, and of others which will become apparent hereafter, one feature of the invention resides in a heat-exchange apparatus, particularly in a cooler for cement manufacture. Briefly stated, the novel apparatus may comprise an upright wall having two sides, one of which is contacted by material to be cooled, cooling means adjacent an upper portion of the other of the sides and including a cooling water receptacle and a downwardly inclined guide baffle extending from the receptacle towards the other side and defining therewith a gap, and a plurality of fibers bridging the gap and having free ends contacting the other side so that cooling water travels from the receptacle over the guide baffle and along the fibers, to be discharged by the same onto said other side as a constant film of substantially uniform thickness.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF A PREFERRED EMBODIMENT

Figure 2:
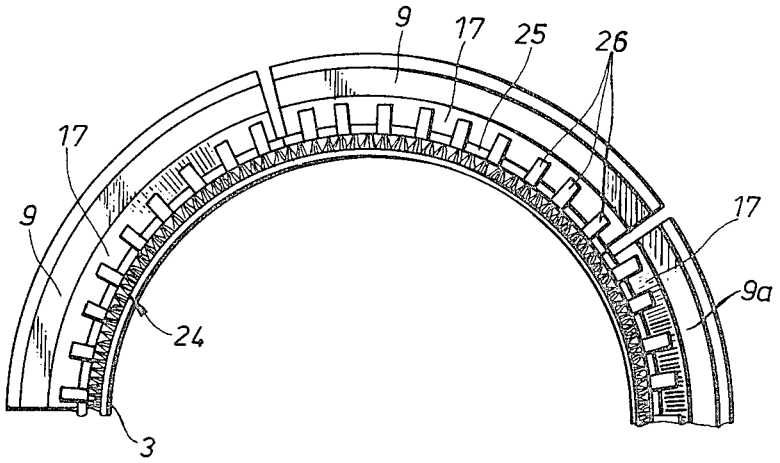
FIG. 2 is a section on line II—II of FIG. 1, with parts omitted for clarity of illustration.
Figure 1:
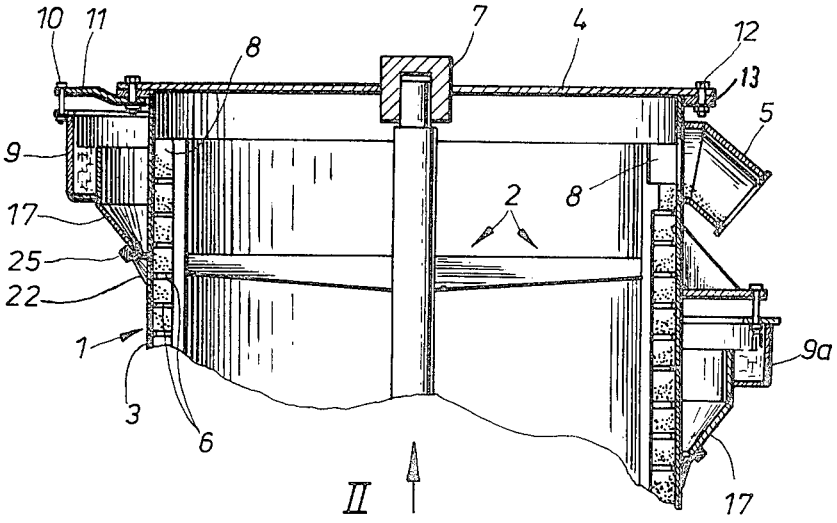
FIG. 1 is a fragmentary vertical center section through an apparatus embodying the invention.
Figure 3:
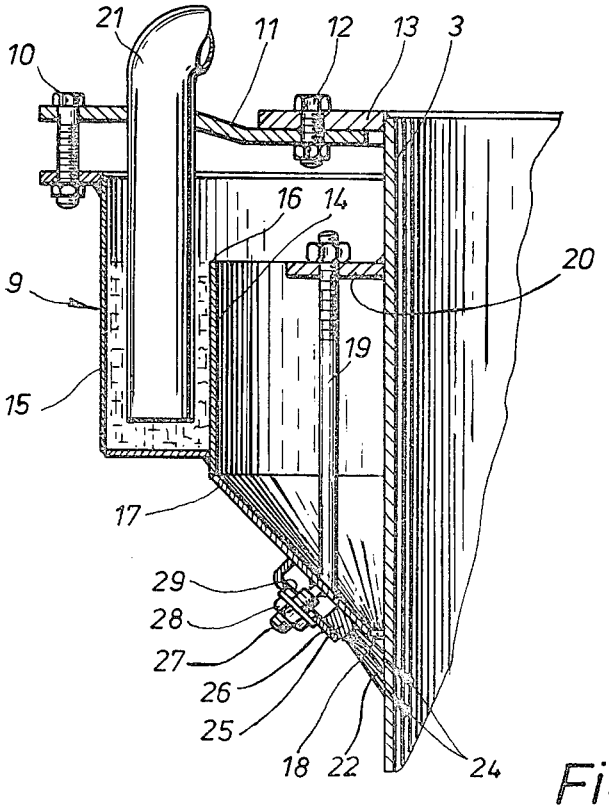
FIG. 3 is a vertical section showing a detail of FIG. 1 on an enlarged scale.
Figure 4:
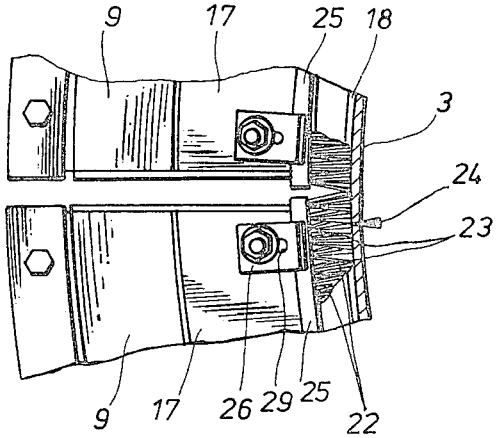
FIG. 4 is a bottom view of FIG. 3, partly in horizontal section.

An exemplary embodiment of the invention is illustrated in FIGS. 1–4. The apparatus has a housing 1 and, within the same, a conveying means for the material to be cooled, here shown as a conveying screw. Housing 1 has an upright (usually vertical) tubular or cylindrical wall 3 the lower end of which is closed by a bottom wall (not shown). The upper end of wall 3 is closed by a removably mounted cover 4. In the manner usual for coolers used in cement manufacture, the housing 1 has adjacent its lower end a (not illustrated) inlet for the hot cement gruel and, diametrically opposite but located adjacent the upper end, an outlet for the cooled material.

The structural and operational details of the conveying screw 2 will not be discussed; they are known per se and form no part of the invention. It will suffice to note that it has screw flights 6 which are located closely adjacent to the inner surface of the jacket 3; the central shaft of the screw 2 is journalled in a journal 7 at the cover 4 and in a similar journal (not shown) at the bottom wall. When the screw 2 is operated by transmitting rotary motion to its central shaft (e.g. via a not-illustrated electric motor and a belt transmission) it advances the material to be cooled upwardly along the inner surface of jacket 3, from the inlet to the outlet 5. Usually, such screws are rotated at about 80 rpm. Above the uppermost screwflight 6 the screw 2 is provided with several expellers or scrapers 8, which may be paddle-shaped and serve to feed the cooled material into the outlet 5.

The purpose of passing the material through the jacket 3 is to cool it. To this end the apparatus is provided with cooling means according to the invention.

Such cooling means comprises an annular trough-shaped receptacle which surrounds the upper end portion of jacket 3. The receptacle could be of one piece; however, in the illustrated embodiment it is of four arcuate sections 9 (not all shown) and a fifth, similar section **9*a* which is located at a level below the sections 9. Such individual sections are advantageous if space limitations or installation problems make the use of a unitary receptacle impracticable. One (as shown) or more of the sections may be located at different levels if this is desirable for structural reasons, e.g. if the outlet 5** or another component are in the way of one or more of the sections.

The sections 9, **9*a* together concentrically surround the jacket 3. Each of them is secured by means of bolts or screws 10 to respective supports 11 which are in turn mounted in bolts or screws 12 on a flange 13 that is secured (e.g. by welding) to the jacket 3 (see FIG. 3 where cover 4** is omitted).

Each of sections 9, **9*a* has an arcuate inner wall 14 of a height which is smaller than its outer wall 15; the upper edge 16 of the inner wall 14 forms an overflow weir for cooling water which is introduced into the respective section 9, 9*a* by an associated supply pipe 21 (a single one could be used to feed all of the sections). Each pipe 21 has interposed in it a valve (not shown) by means of which the inflow of water (from a not shown source) can be regulated, whereby the film thickness can be controlled. The ends of the sections 9, 9*a* may of course be closed when separate pipes 21** are used.

Secured (e.g. welded) to the lower end of each wall 14 is a sheet-metal guide baffle 17 which is inclined downwardly and towards the jacket 3. The radial width of each baffle 17 is so selected that a gap 18 remains between its inner edge and the outer surface of jacket 3. A pair (one shown) of adjusting screws 19 is fixedly connected (e.g. by welding) with each of the baffles 17. The screws 19 of each pair are spaced circumferentially of the jacket 3; the upper end of each is connected to a lug 20 welded to the jacket 3. Turning the nuts of screws 19 makes it possible to adjust the weir 16 so that it is located in a horizontal plane in order to assure a uniform flow of water over the weir 16 at all longitudinal points of the same.

The gap 18 is bridged (see FIGS. 3 and 4) by tufts or bundles 22 composed of fibers 23 which are made of a durable material, preferably a durable synthetic plastic such as polyamide (available, inter alia, under the tradename Perlon). The free end of each fiber engages the jacket 3 and is preferably so cut that its end face extends parallel to the outer surface of the jacket 3. This provides for maximum surface-to-surface contact between each fiber and the jacket 3, a consideration which is important for applying the cool water to the jacket.

The bundles or tufts 22 are arranged in form of one or more (two shown) rows 24 of fibers; if two or more rows are present they extend parallel to one another. The fibers 23 are secured in an arcuate mounting element 25 (together these elements form an annular element). Each arcuate element has a length slightly in excess of the associated baffle 17 (see FIG. 4). Each section 25 is secured to the respective baffle 17 by clamping members 26 which are pressed against the respective section 25 via bolts 27, secured (e.g. welded) to the baffle 17 and cooperating nuts 28. Members 26 have slot-shaped openings 29 through which the bolts 27 extend, to permit shifting of the members 26 relative to the associated baffle 17; this enables a user to move the sections 25 towards or away from the jacket 3 and to thereby dispose the free end faces of the fibers 3 of each row 24 in precise parallelism with the surface of jacket 3. This allows adjustment for the fact that the jackets 3 are rarely completely round or have other manufacturing problems. The arrangement of the fibers in rows assures uniform water distribution over the entire circumference of the jacket while avoiding sheeting or splashing. It also properly bridges the gap 18.

In operation each section 9, **9*a* is continuously supplied with cooling water (at about 20° C.) via the associated pipe 21. The water flows uniformly over the weir 16 and down over the wall 14 and the baffle 17. It then flows through the gap 18 onto the fibers 23 of the fiber rows 24. Since the fibers 23 are themselves downwardly inclined and engage the jacket 3, the cooling water (which adheres to the fibers 23 and flows along the same) is transferred to the jacket 3 as a film of uniform and constant thickness without any sheeting or splashing whatever. This film may have a thickness of, say 0.5 mm and, being present uniformly over the entire circumference of jacket 3, guarantees effective and uniform cooling of the material which moves in the jacket 3** in counter flow at a temperature up to about 120° C.

The invention thus provides for a very uniform distribution of the cooling water over the entire circumference of the jacket 3, in form of a thin but uniform and constant film. It reliably avoids conversion of the cooling water into steam, as well as sheeting or splashing. The amount of cooling water required can be held to a minimum. Moreover, if any sizable contaminants drop into the gap 18, they can in no way influence the distribution of the water and its application to the jacket 3 in a uniform film. They can be quickly removed by pushing the (elastically yieldable) fibers of the rows out of the way and wiping the contaminants out of the gap.

While the invention has been illustrated and described as embodied in a cooler for cement manufacture, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a heat-exchange apparatus, particularly in a cooler for cement manufacture, a combination comprising an upright wall having two sides, one of which is contacted by material to be cooled; cooling means adjacent an upper portion of the other of said sides and including a cooling water receptacle and a downwardly inclined guide baffle extending from said receptacle towards said other side and defining therewith a gap of non-uniform width; and a plurality of fibers bridging said gap and having free ends contacting said other side so that cooling water travels from said receptacle over said guide baffle and along said fibers to be discharged by the same onto said other side as a film which has a constant and substantially uniform thickness despite the non-uniform width of said gap.

2. A combination as defined in claim 1, wherein said wall is a tubular wall, and said one and said other side are the inner and outer sides of said tubular wall, respectively.

3. A combination as defined in claim 2, wherein said receptacle, said guide baffle and said gap are all annular.

4. A combination as defined in claim 2, wherein said fibers are arranged in form of a plurality of tufts.

5. A combination as defined in claim 2, wherein said fibers form at least one annular row; and further comprising an annular mounting element mounting said fibers of said row.

6. A combination as defined in claim 2, wherein said fibers form at least two rows; and further comprising an annular mounting element mounting said fibers of said rows.

7. A combination as defined in claim 6, wherein each of said rows is composed of a plurality of tufts of said fibers.

8. A combination as defined in claim 1, wherein said free ends of said fibers have respective end faces which extend parallel to a surface of said other side.

9. A combination as defined in claim 1, wherein said fibers are of synthetic plastic material.

10. In a heat-exchange apparatus, particularly in a cooler for cement manufacture, a combination comprising an upright tubular wall having two sides, one of which is contacted by material to be cooled; cooling means adjacent an upper portion of the other of said sides and including a cooling water receptacle and a downwardly inclined guide baffle extending from said receptacle towards said other side and defining therewith a gap; at least one row of fibers extending about said other side and bridging said gap, said fibers having free ends contacting said other side so that cooling water travels from said receptacle over said guide baffle and along said fibers to be discharged by the same onto said other side as a constant film of substantially uniform thickness; an annular mounting element mounting said at least one row of fibers; and means mounting said mounting element on said guide baffle adjustable relative to the same and to said other side of said wall.

11. In a heat-exchange apparatus, particularly in a cooler for cement manufacture, a combination comprising an upright tubular wall having two sides, one of which is contacted by material to be cooled; cooling means adjacent an upper portion of the other of said sides and including a trough-shaped cooling water receptacle composed of a plurality of arcuate sections which together concentrically surround said tubular wall, and a downwardly inclined guide baffle extending from said receptacle towards said other side and defining therewith a gap; and a plurality of fibers bridging said gap and having free ends contacting said other side so that cooling water travels from said receptacle over said guide baffle and along said fibers to be discharged by the same onto said other side as a constant film of substantially uniform thickness.

12. A combination as defined in claim 11, wherein at least one of said sections is located at a level lower than the level at which the other sections are located.

* * * * *